United States Patent [19]

Governale

[11] Patent Number: 4,891,921

[45] Date of Patent: Jan. 9, 1990

[54] SLIDING DOOR ASSEMBLY WITH WEATHER SEAL STRUCTURE

[75] Inventor: Bernard C. Governale, Duluth, Ga.

[73] Assignee: Peachtree Doors, Inc., Norcross, Ga.

[21] Appl. No.: 31,536

[22] Filed: Mar. 30, 1987

[51] Int. Cl.[4] ..... E04B 65/08; E05C 9/12

[52] U.S. Cl. ..... 52/207; 70/95; 70/99; 292/39

[58] Field of Search ..... 52/207, 127.7, 127.8, 52/127.11, 127.12, 204; 49/425, 404, 207, 308, 317, 320, 321, 408, 410, 411, 406, 449, 370; 160/90, 91; 70/95, 99; 292/DIG. 46, 39

[56] References Cited

U.S. PATENT DOCUMENTS

| | | | |
|---|---|---|---|
| 2,166,535 | 7/1939 | Sarenholm | 292/39 X |
| 2,317,312 | 4/1943 | Swanson | 49/449 |
| 2,584,088 | 1/1952 | Floyd | 292/39 |
| 2,668,318 | 2/1954 | LeBon, III . | |
| 2,787,154 | 4/1957 | Wesberry | 292/39 |
| 2,819,107 | 1/1958 | Muessel . | |
| 2,911,688 | 11/1959 | Osten | 49/408 |
| 2,924,475 | 2/1960 | Russell | 292/DIG. 46 |
| 3,046,776 | 7/1962 | Marotto | 292/DIG. 46 |
| 3,086,383 | 4/1963 | Scott | 292/39 |
| 3,111,726 | 11/1963 | Grossman . | |
| 3,208,111 | 9/1965 | Grossman . | |
| 3,209,411 | 10/1965 | Sprague, Jr. . | |
| 3,295,587 | 1/1967 | Horgan | 160/91 |
| 3,308,579 | 3/1967 | Thams | 292/39 |
| 3,314,201 | 4/1967 | Riegelman . | |
| 3,344,575 | 10/1967 | Grossman . | |
| 3,429,075 | 2/1969 | Grossman . | |
| 3,722,236 | 3/1973 | Zelenko . | |
| 4,009,537 | 3/1977 | Hubbard | 49/319 |
| 4,044,504 | 8/1977 | Nakada | 160/90 |
| 4,204,724 | 5/1980 | Bauer et al. . | |
| 4,315,647 | 2/1982 | Wilzig et al. . | |
| 4,319,430 | 3/1982 | Menard . | |
| 4,399,636 | 8/1983 | Blackwell | 160/91 |
| 4,434,635 | 3/1984 | Borgato | 70/95 X |
| 4,443,984 | 4/1984 | Rasmussen | 52/211 |
| 4,475,313 | 10/1984 | Governale . | |
| 4,500,122 | 2/1985 | Douglas . | |
| 4,532,743 | 8/1985 | Miller | 52/207 |
| 4,554,770 | 11/1985 | Anders . | |
| 4,558,536 | 12/1985 | Dunsmoor . | |
| 4,616,864 | 10/1986 | Douglas | 292/39 |
| 4,643,005 | 2/1987 | Logas | 292/DIG. 46 |
| 4,667,441 | 5/1987 | Coddens | 49/404 |
| 4,674,246 | 6/1987 | Giguere | 49/404 |
| 4,754,624 | 7/1988 | Fleming | 292/39 X |
| 4,763,446 | 8/1988 | Kelley | 52/207 |

FOREIGN PATENT DOCUMENTS

| | | | |
|---|---|---|---|
| 2327713 | 1/1975 | Fed. Rep. of Germany | 49/317 |
| 6800155 | 7/1969 | Netherlands | 49/408 |
| 444994 | 4/1936 | United Kingdom | 49/317 |

*Primary Examiner*—John E. Murtagh

*Attorney, Agent, or Firm*—Kimmel, Crowell & Weaver

[57] ABSTRACT

A sliding door assembly having a frame including a head jamb, a bottom sill, two vertical side jambs and a third center jamb for strength and rigidity of the overall frame. A fixed glass panel is mounted in a portion of said frame and a sliding glass panel mounted upon roller structure is mounted in another portion of the frame. The sliding glass panel has an extending fin around at least three sides thereof for cooperative association with weather seal structure provided with the non-movable portions of the assembly. The aluminum sill structure has self-draining slots therein and a replaceable plastic member is provided with the sill for ease of sliding of the sliding glass panel, as well as easy replacement thereof, if needed. Draining slots are also provided in the plastic member which are staggered relative to the slots in the aluminum to minimize wind blow through. The door assembly has an aluminum exterior and a wood interior, with the wood portion being removably attached by spring clips. Three-point locking structure is provided for the sliding glass panel, which is designed so that same can be either right-handed or left-handed, as needed at the actual job site. All portions of the assembly are designed for ease of changeability from one hand to the other.

23 Claims, 10 Drawing Sheets

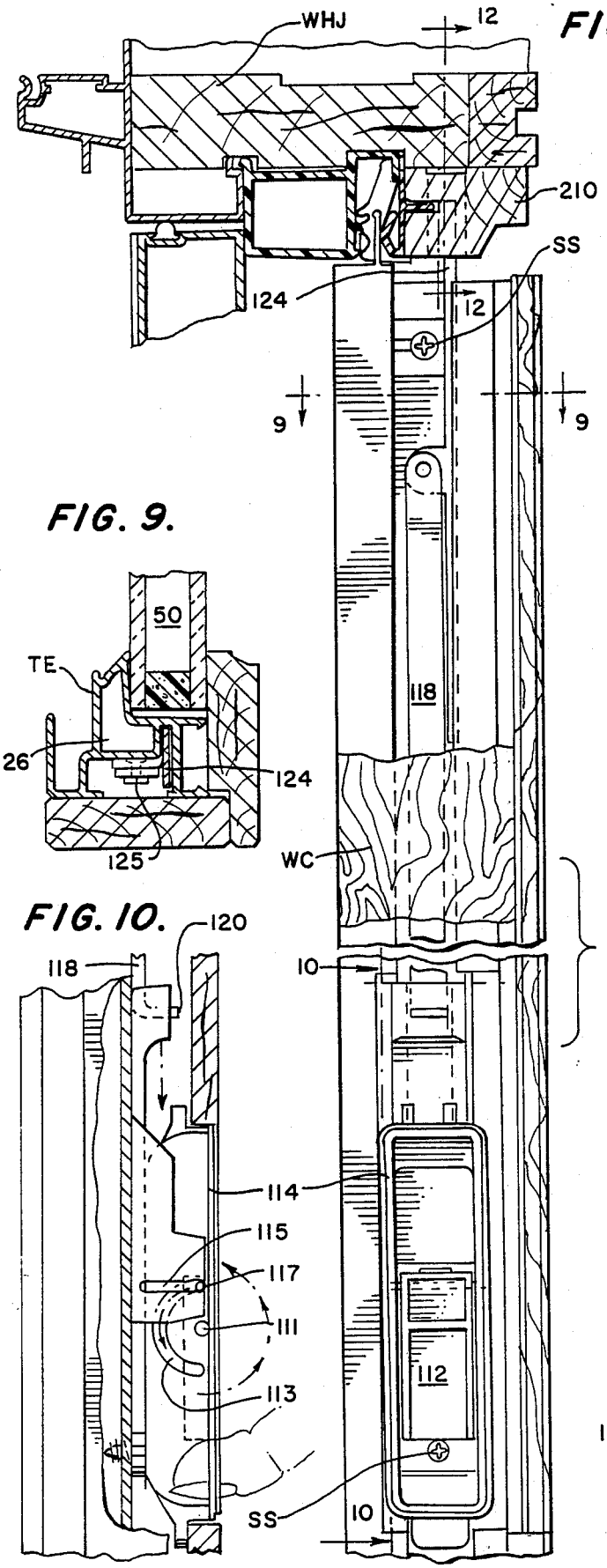
FIG. 8.
FIG. 9.
FIG. 10.
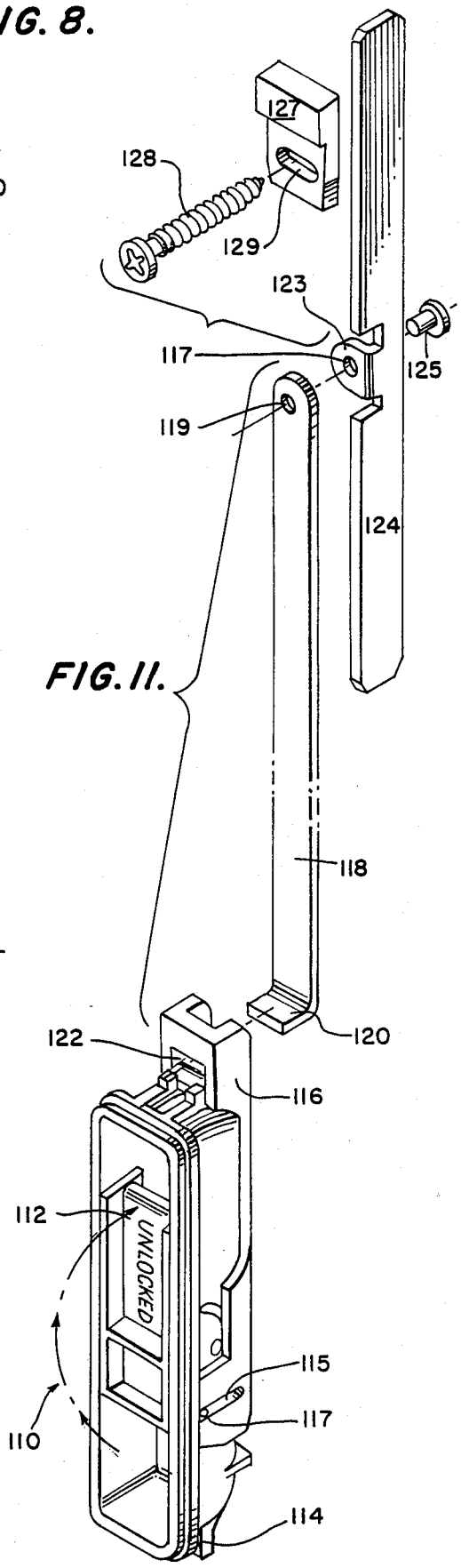
FIG. 11.

SLIDING DOOR ASSEMBLY WITH WEATHER SEAL STRUCTURE

BACKGROUND OF THE INVENTION

1. Background of the Invention

This invention relates generally to sliding patio doors, and to improvements in the construction thereof.

2. Description of the Prior Art

A common problem with known patio doors of conventional type is that they are not nearly as airtight and weather proof as desired. Another common problem is that conventional type doors are designed to be either right-handed or left-handed, and once pre-assembled, cannot be easily converted to the other hand. Strength, stability and rigidity of the conventional type door assembly also, in many cases, leaves much to be desired. A common problem also is in the locking mechanism for the sliding panel of such doors.

Additional problems encountered with conventional type patio doors is in the sill construction of the door frame. Many sills are non-replaceable and also made entirely of metal without any provision for replacement when wear takes place other than by completely replacing the entire sill unit. While most sills do have draining provision to permit egress of accumulated water, the overall arrangement of known types leaves much to be desired.

Another problem with conventional type doors made of metal is that the interior thereof also is of metal and therefore lacks the pleasing appearance of wood. While doors that are made of wood, of course, would have the pleasing appearance on the interior, the outside thereof lacks the ruggedness and weatherability of the metal type.

Lock systems for known type doors fail to provide the overall security and protection that is highly desirable. A locking system which is foolproof and yet easy to operate is very desirable.

SUMMARY OF THE INVENTION

An object of the present invention is to provide a sliding patio door assembly having a five element frame together with at least one fixed glass panel and at least one sliding glass panel. Weather sealing structure is provided with both the sliding glass panel and the frame assembly for complementary association with each other.

Another object of the present invention is to provide a sliding patio door assembly which can be easily changed from right-hand to left-hand or vice versa. All of the structural elements, including the three-point locking structure, the fixed and movable glass panels, and associated frame elements, can be quickly and easily reversed to change from one hand to the other.

A further object of this invention is to provide a sliding door assembly having the ruggedness and weatherability of metal on the exterior, with the warmth and pleasing appearance of wood on the interior. Removable and replaceable wood inserts attached by spring clips are provided for the inside portion of the door assembly.

A still further object of the present invention is to provide a door assembly having a three-point locking system. Such locking system greatly improves the security and protective aspects of such assembly.

Another object is to provide a door assembly which may be composed of multiple units having a plurality of panels, some fixed and some sliding.

A still further object of the present invention is to provide a sliding glass patio door structure having a greatly improved sill. The sill structure has staggered weep holes to allow egress of any water and prevent buildup thereof, with the weep holes being staggered to prevent wind blow through. Another important element of the sill structure is a removable and replaceable plastic member upon which the sliding glass panel moves. Appropriate weather sealing structure is included with this replaceable plastic member.

The present invention has a number of new and novel features. Among them are the presence of a fifth frame member comprising a vertical center post between the header jamb and the sill which is substantially parallel to a pair of side vertical jambs. This fifth member greatly increases the overall strength and rigidity of the outside frame structure. At least one fixed panel and at least one sliding glass panel are mounted with the frame assembly. A locking system consisting of two oppositely moving projecting bolts together with a complementary frame reception plate greatly improves the security of the overall door once installed. Guide pins also are associated with the pair of projecting lock bolts to make sure that they properly align with the reception holes in the complementary vertical jamb. Reversibility of this lock structure is important in keeping with the adaptability of the overall assembly for either right-hand or left-hand installation. A third or auxiliary lock adds further security to the sliding glass panel and also prevents same from being lifted out of the frame. Furthermore, the auxiliary or third lock can cooperate with the upper head jamb in a partially open position of the sliding panel so that same can be secured with only a small 4"–6" opening to permit ventilation, but which will prevent a person from squeezing through the open area.

Another feature of the present invention is the weathering system structure which includes the mounting of the glass with the frame, the system of drainage through the sill plate, and especially the projecting fin around the circumference of both the fixed and movable door panels which cooperate with the frame channels and associated seal members. Preferably, seal members are provided both externally of the fixed and sliding panels as well as on the interior thereof. Such dual sealing structure, in cooperation with the projecting fin structure, greatly increases the overall effectiveness and weather tightness of the patio door assembly.

The present sliding patio door has eight major improvements:

(1) greatly increased structural strength;

(2) an improved and superior locking system;

(3) an improved glazing arrangement;

(4) a much better and more efficient self-draining sill system;

(5) greatly improved overall weatherability of the entire door assembly;

(6) greatly improved finishing convenience;

(7) substantially improved operating ease; and (8) compatibility with similarly constructed windows.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 8 is an end elevational view, partly in cross-section, taken along line 8—8 in FIG. 1B, of the sliding glass panel showing the reversible third lock mechanism.

FIG. 9 is a cross-sectional view taken generally along line 9—9 of FIG. 8.

FIG. 10 is a partial side elevational view of the third lock actuating mechanism.

FIG. 11 is an exploded perspective view of the reversible third lock mechanism.

DESCRIPTION OF THE PREFERRED EMBODIMENTS

Figure 1A:
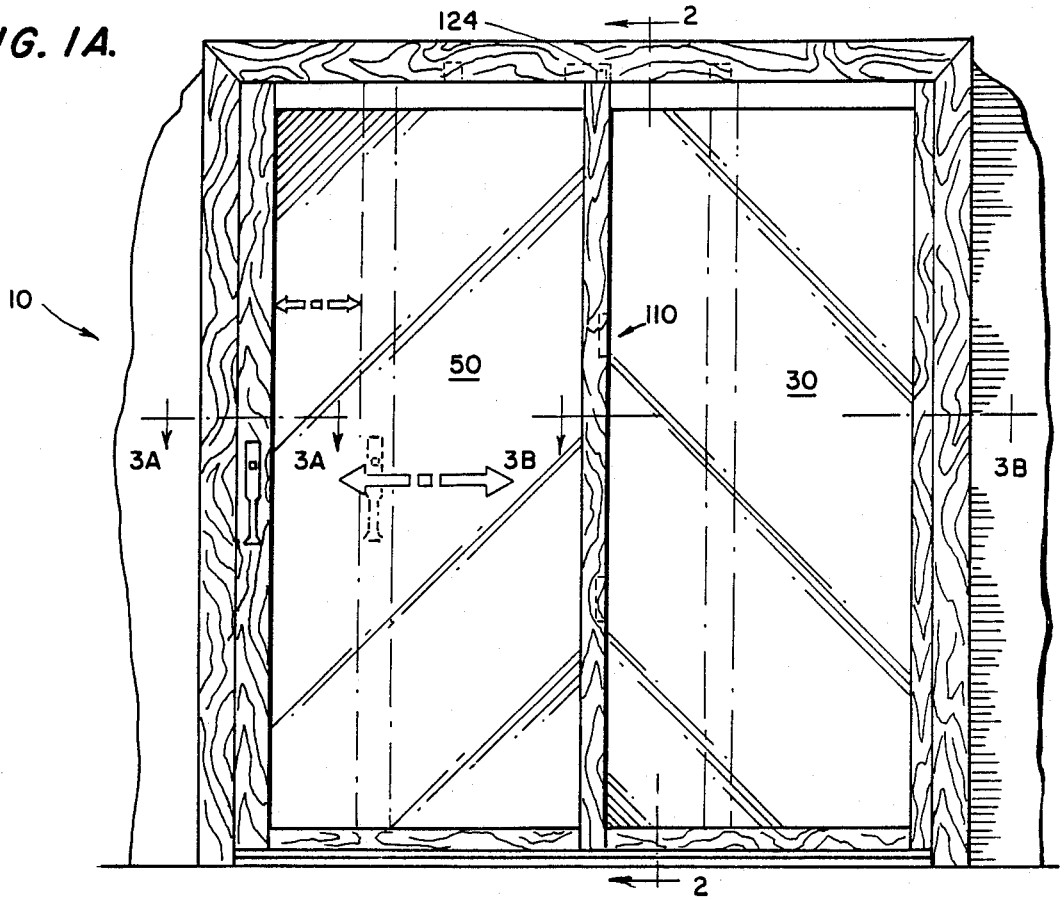
FIG. 1A is a front elevational view of the left-hand sliding glass door assembly of the present invention.
Figure 1B:
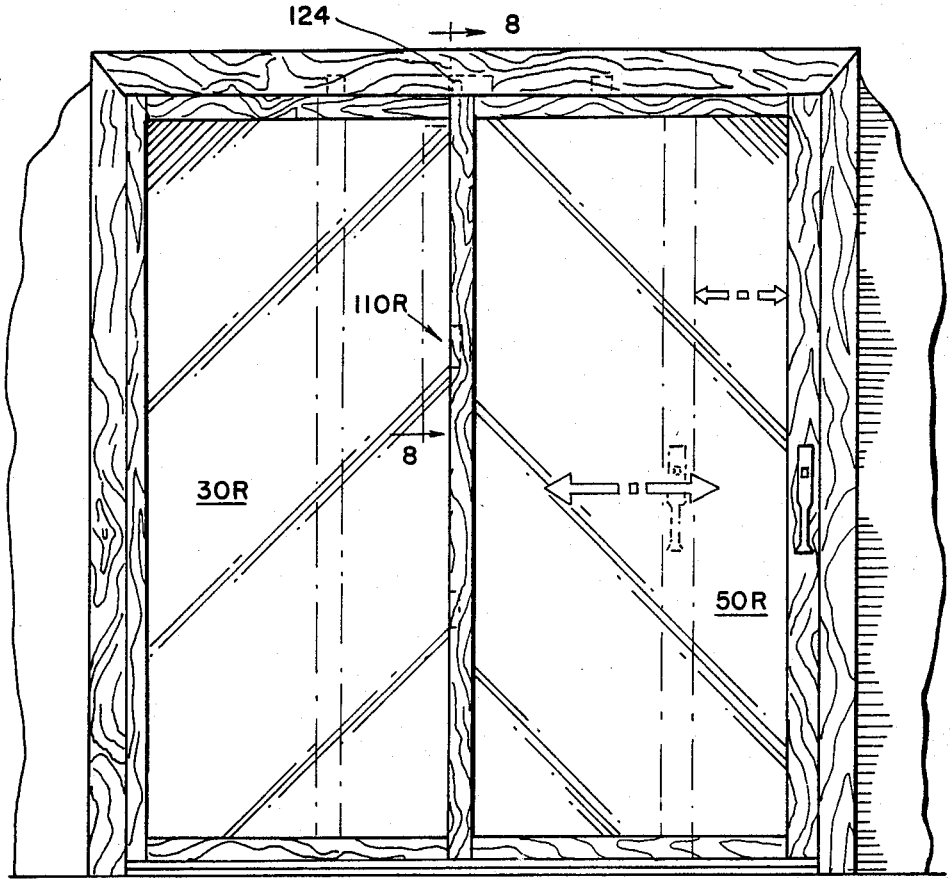
FIG. 1B is a front elevational view of the right-hand sliding glass door assembly of the present invention.

Looking at FIG. 1A of the drawings, reference numeral 10 indicates a left-hand configuration of the sliding glass patio door assembly of the present invention. FIG. 1B depicts the same door with the important components reversed, so that the door will be right-handed. A very important feature of the present invention is in the easy changeability from one hand to the other without any difficulty by the average worker on the job site. While most conventional type doors can be reversed in hand, most of them do not permit the reversibility to be done easily and quickly and are not so designed. This door is. Furthermore, the locking mechanism and the weatherproofing seal means, together with the projecting flange of the sliding glass panel, provides equally as good weather sealing in either configuration. Again, this is the feature missing from conventional type doors.

Looking at FIGS. 1A–3B, the basic structure of the door assembly of the present invention will be described in general. The overall frame assembly comprises a wood head jamb WHJ, a sill 70, a pair of vertical jambs VJ, and a center post CP. In the embodiment depicted in FIGS. 1A and 1B, a fixed panel 30 is installed between the center post CP and one of the vertical jambs, depending on whether the installation is to be right-handed or left-handed. Of course, according to the desired hand, the other component elements are installed to conform therewith. These will be described later in detail. FIGS. 1A, 2 and 3A, 3B each depict the left-hand configuration of the door assembly. In this configuration the sliding glass door panel 50 is on the left as viewed in FIG. 1A.

Figure 2:
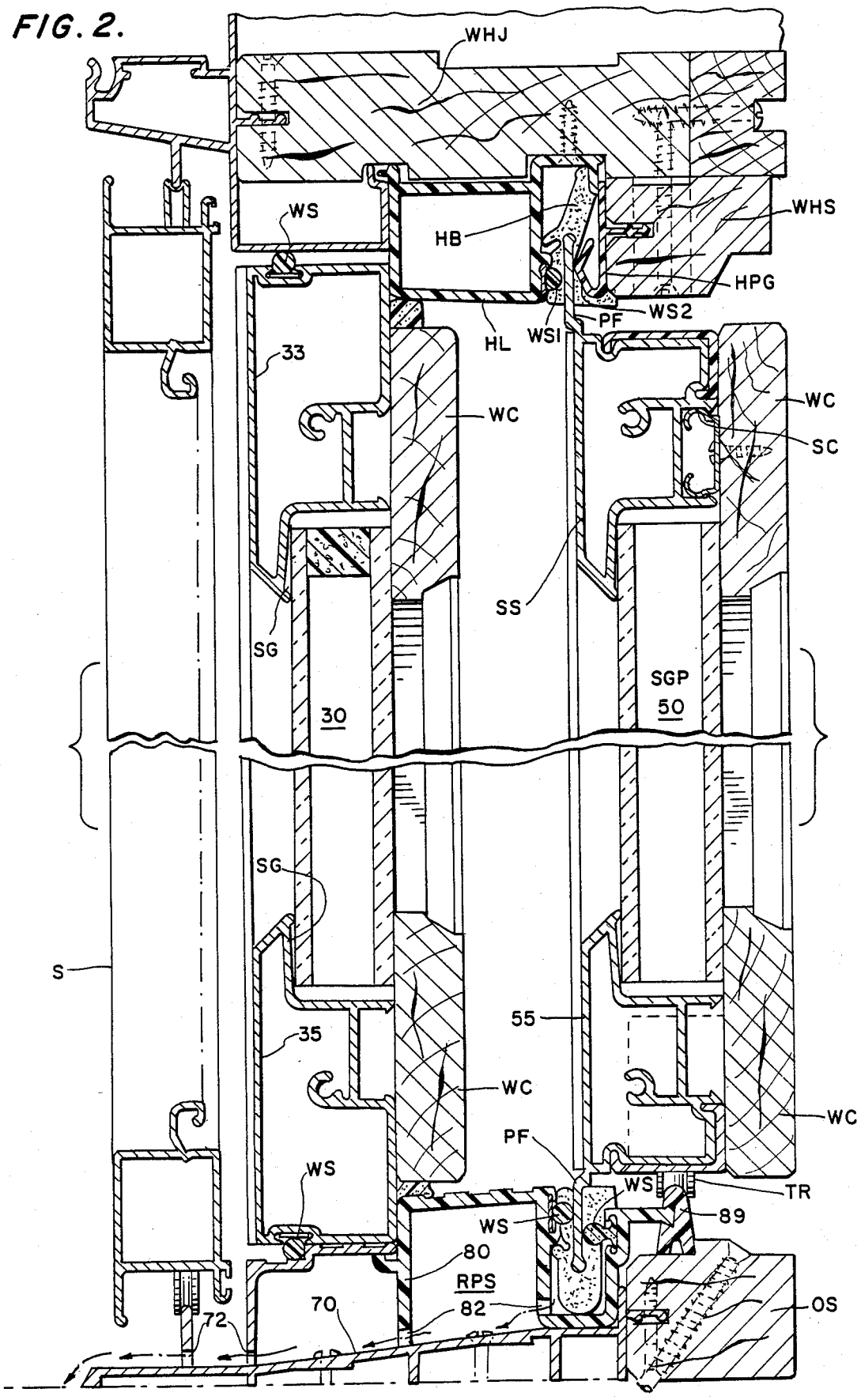
FIG. 2 is a side elevational view, partly in cross-section, taken generally along line 2—2 of FIG. 1A.
Figure 3A:
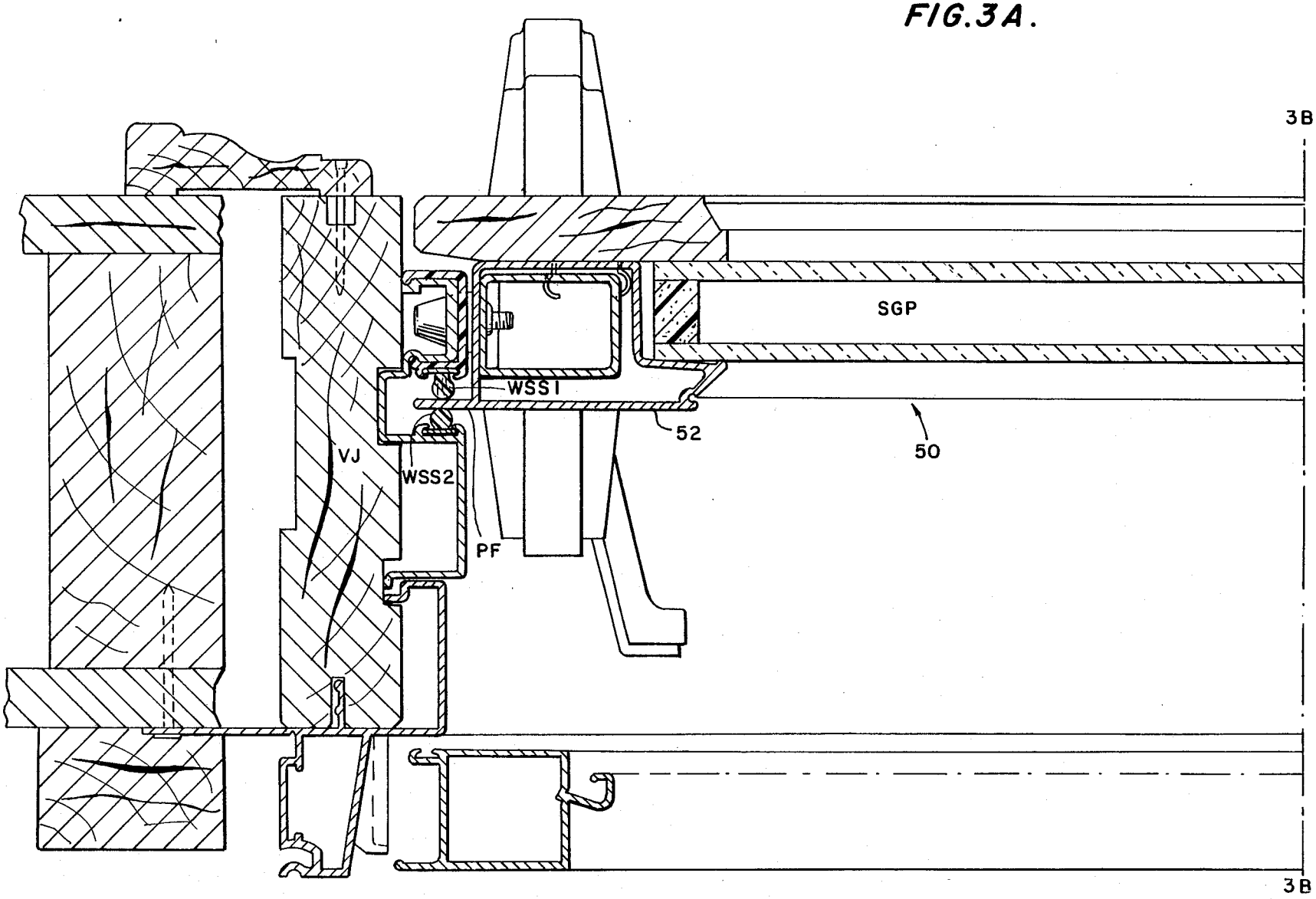
FIGS. 3A and 3B are cross-sectional views taken generally along lines 3A and 3B, respectively, of FIG. 1A.
Figure 3B:
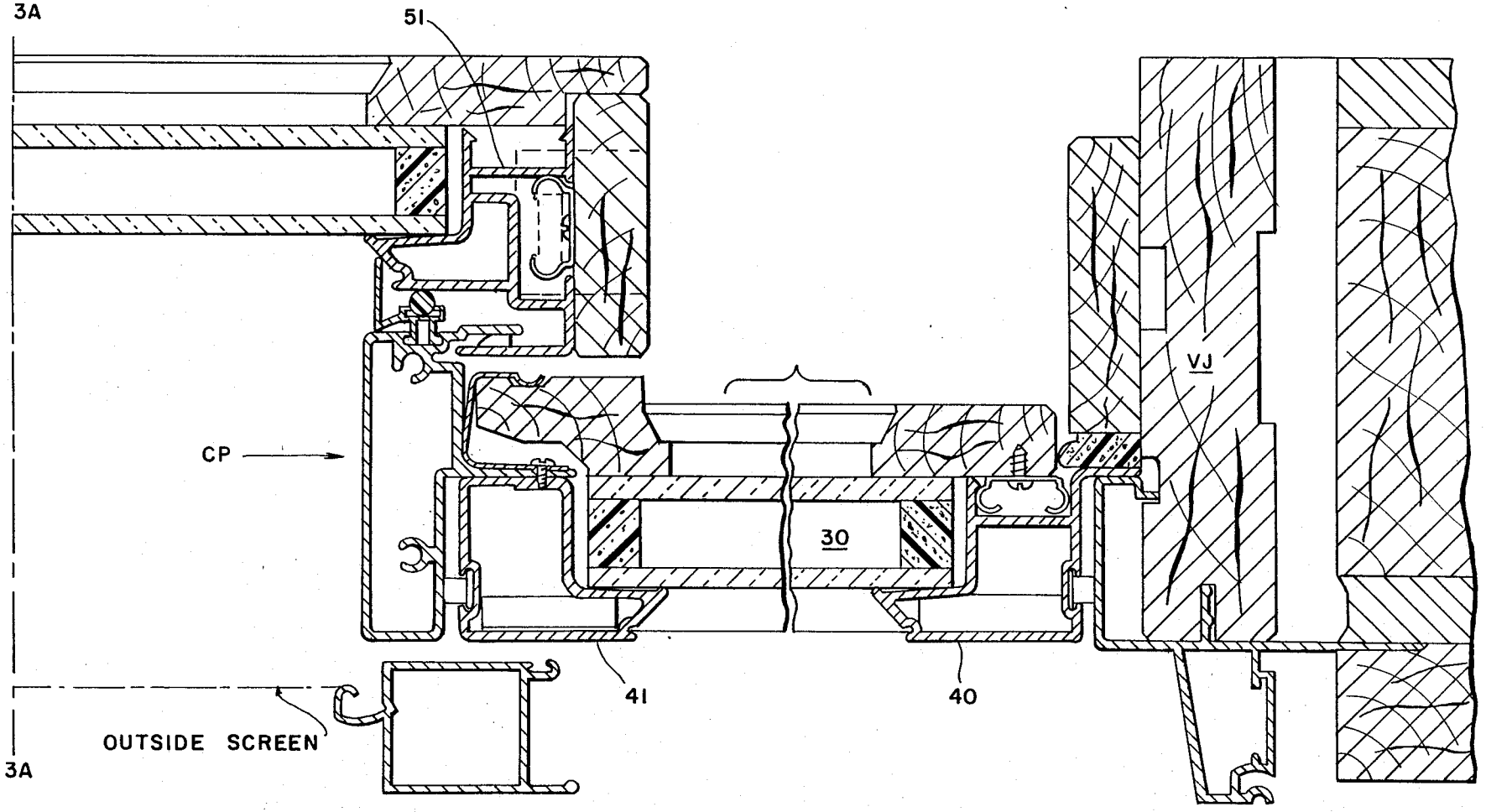

As best seen in the side section of FIG. 2, the fixed panel 30 has upper and lower extrusions of aluminum 35, with similar extrusions 40 and 41 depicted in FIG. 3B for the sides of the fixed panel. All of these extrusions are of contemporary and conventional design.

Similarly, the sliding glass door panel 50 has upper and lower extrusions 55, with similar extrusions 51 and 52 for the side jambs of this panel (FIGS. 3A and 3B). Preferably, the glass of both panels is of thermal double pane construction and is installed with the framework for the respective doors with high grade silicone sealant. An outside screen S with suitable sliding frame is normally provided to cover the portion having the sliding glass door panel.

As shown in FIG. 2, a plastic head liner HL is attached and affixed to the wood head jamb for association with the respective door panels. A head bumper HB is shown for association with the sliding glass panel 50; however, it should be noted that this is just a short bumper of approximately 4″ or so at one end of the track. It does not extend the entire length of this head liner HL. More importantly, the weather stripping structure $WS_1$ and $WS_2$ form a very essential part of the present invention. The weather sealing structure $WS_1$ preferably is a flexible mounting or holding strip having a projecting foam strip extending perpendicular thereto which is suitably covered with flexible plastic adhered to the main holding body strip. This seal $WS_1$ has the main body strip slid into an appropriate recessed groove in the head liner HL molding. A semi-rigid, yet somewhat flexible, weather seal $WS_2$ is affixed to the wood head stop WHS and associates with the first weather seal $WS_1$ to provide weather sealing structure opposite each other and for mating with the projecting fin PF of the sliding glass door panel. It should be noted that the projecting fin PF for the sliding glass panel 50 extends across the top, the closure edge and the bottom of this panel. The only side of the panel that does not have such a fin is the lock closure side or trailing edge which receives the third lock actuating mechanism.

Silicone sealant SG is shown in FIG. 2, sealing the double panel glass panels of the sliding panel 50 to the aluminum frames 55, the other figures; however, of course, it would be used in all appropriate places. The fixed panel 30 also has appropriate weather seal structure around the perimeter thereof which is installed in a complementary track for the support strip of the seal which is appropriately installed prior to installation of the fixed panel into the overall frame.

Before leaving FIGS. 1A and 1B, it should be noted that the sliding glass door panel 50 can be partially opened and locked and such partially open position is depicted by the dotted lines in each of these figures. The third lock mechanism 110, which is mounted in the trailing edge of the movable panel, has a projecting lock member 124 which mates with appropriate locking recesses in the head jamb structure. As will be explained in greater detail below, this third lock not only greatly increases the overall security of the locked sliding panel when completely closed, but also permits it to be locked with the panel open a few inches so that ventilation can take place without anyone being able to enter or egress through the door.

Figure 4:
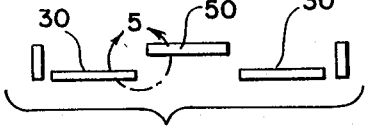
FIG. 4 is a schematic showing of a three panel door assembly.
Figure 5:
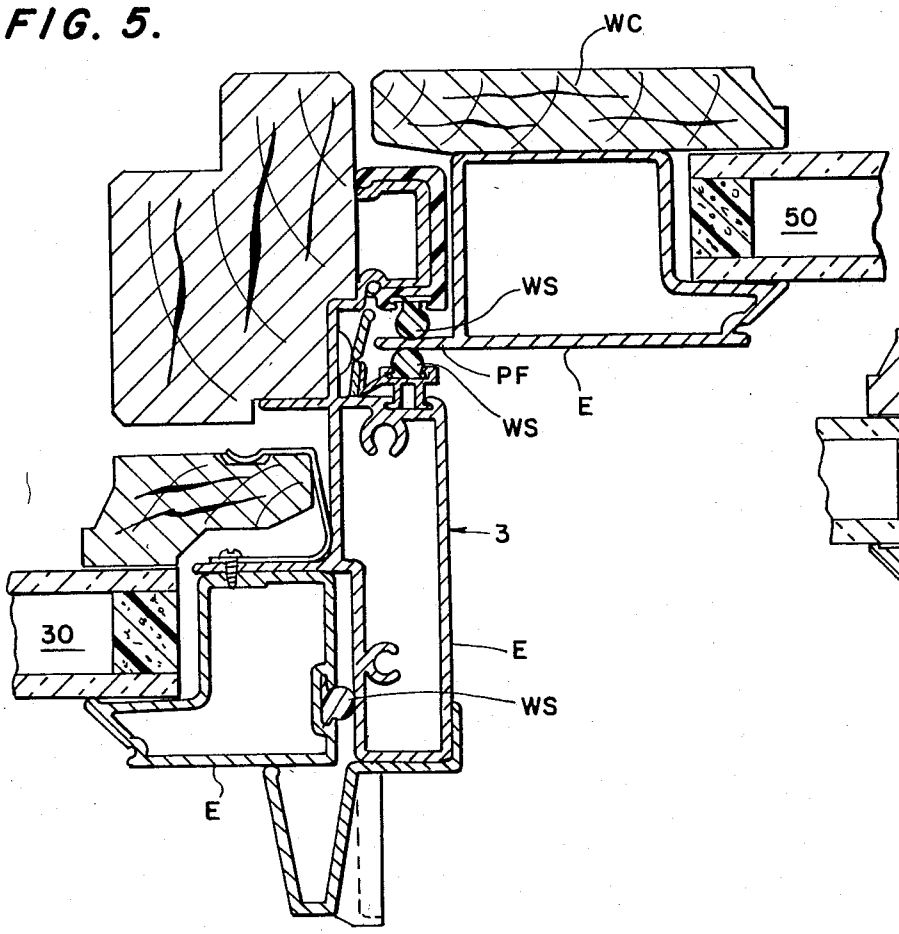
FIG. 5 is a cross-section taken along the encircled 5 portion of FIG. 4.

Looking at FIGS. 4 and 5, a three panel door configuration is depicted. Suitable metal extrusions E, preferably of aluminum, are associated with the various components, as well as weather seal structure WS. A projecting flange PF from the movable door panel 50, as already described, is also included because this fin, together with the associated oppositely opposed weather seals, is a very important aspect of the present invention. Also, wood covers WC for the inside of the structure are included with suitable spring clips as appropriate for holding them removably in place against the metal extrusions of the overall assembly. This, of course, is another important feature of the present assembly, wherein aluminum for strength, durability and weather resistance is used on the exterior portions of the door assembly, while wood covering is provided for the interior surfaces for the warmth and pleasing appearance rendered thereby.

Figure 6:
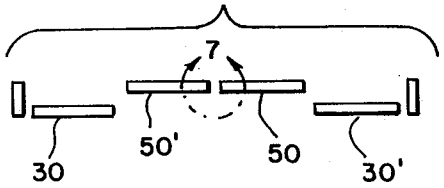
FIG. 6 is a schematic showing of a four panel door assembly.
Figure 7:
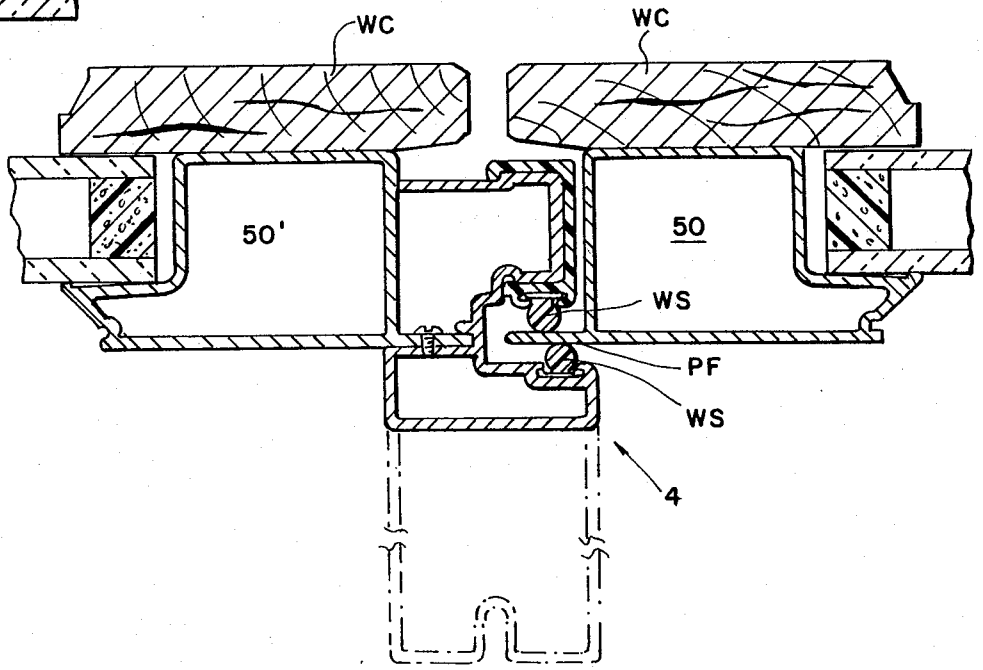
FIG. 7 is a cross-sectional view taken along the encircled 7 portion of FIG. 6.

FIGS. 6 and 7 depict a four panel door configuration with the modifications of the mating extrusions and projecting fin PF, etc. being shown in cross-sectional detail in FIG. 7. It should be noted that the basic structure of FIGS. 1A–3B is employed with the modifications of the multiple panel door assemblies of FIGS. 4–7.

FIGS. 8–11 show the construction and assembly of the reversible third lock mechanism. This overall third lock 110 has a movable locking lever 112 which is pivotally mounted from a frame assembly 114. When lever 112 is pivoted about axis 111, it will cause a pin 117 to move around the circumferential half slot 113. As pin 117 so moves, it will effect a longitudinal movement of U-shaped channel slide 116 because of the slot 115 therein. Movement of the U-channel 116 longitudinally or up and down effects up and down movement of the connecting bar 118 because of the right angle portion 120 riding in the slot 122 of channel member 116. The other end of bar 118 is provided with a hole 119 for reception of a pivot rivet 125 affixedly therein. The rivet 125 pivotally mounts the locking bar 124 on the end of sliding bar 118. Locking bar 124 has a suitable flange 123 extending 90° therefrom with aperture 117 therethrough. As can best be seen in the cross-section of FIG. 9, the locking bar 124 moves within a recess 126 of the trailing edge extrusion TE for the sliding glass door 50. As can be seen in FIG. 8, when the lock is on, the upper end of locking bar 124 extends into an appropriate receiving aperture in the head stop 210. This is shown in greater detail in FIGS. 11–14. In order to assure that the locking bar will remain within the recess 125 of the extrusion, a plastic block 127 is appropriately affixed by screw 128 into the extrusion channel. However, if it is desired, the hand of the door assembly can be reversed by simply removing screw 128 and the screw (not shown) for holding the lock housing 114 with extrusion TE, and then these parts can be flipped over to the other end of the door. The reason for the pivot mounting of the locking bar 124 to the actuating bar 118 is to permit the lock bar 124 to ride in the channel 125 from either end of the sliding glass panel. While this structure is fairly simple, it is unique to the industry and is one of the important features of the present invention. In summary, just by removing a couple of ordinary screws, the third lock assembly can be completely reversed when the sliding glass panel is turned end-for-end in order to change the door operating configuration from one hand to the other.

Figure 12:
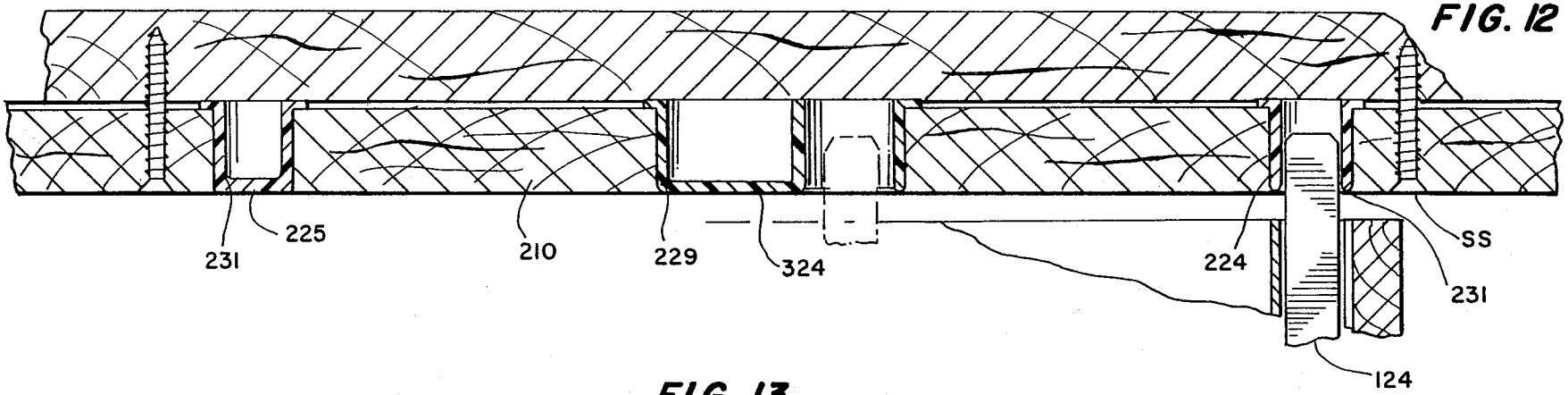
FIG. 12 is a showing of the head stop with reversible lock plugs for reception of the lock plunger of the third lock depicted in FIGS. 8–11, for use in FIG. 1A.
Figure 13:
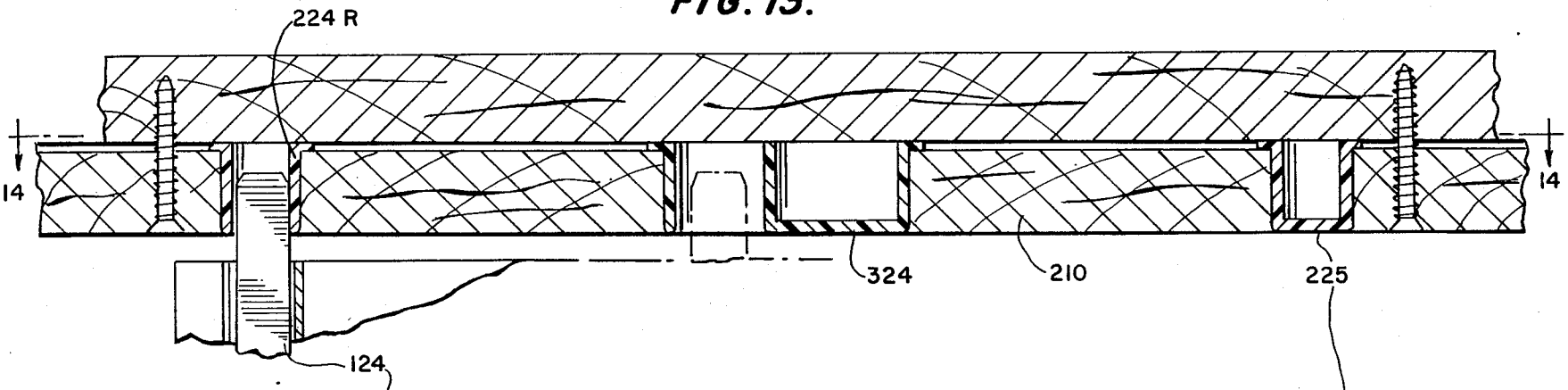
FIG. 13 is the head stop with the lock plugs reversed as depicted for use with FIG. 1B.
Figure 14:
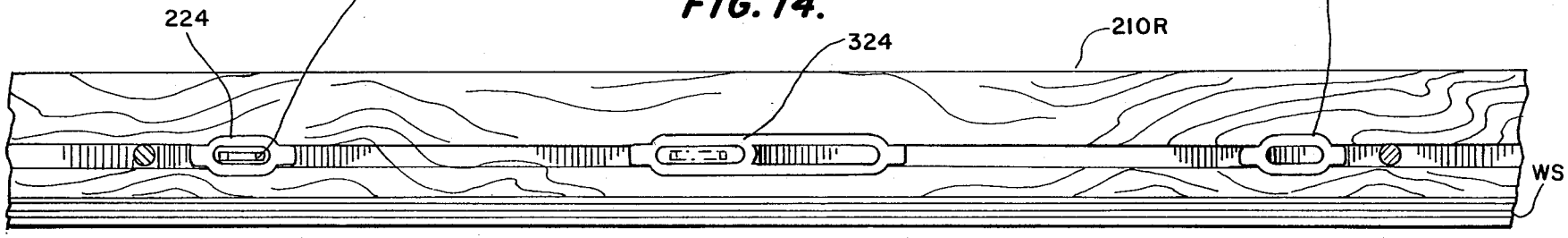
FIG. 14 is a view taken generally along line 14—14 of FIG. 13.

FIGS. 12–14 show the overhead stop with reversible lock plugs for the third lock just described. This wood head stop 210 is provided with a plurality of apertures therealong. The center aperture 229 receives a reversible lock plug 324 therein. End apertures 231 similarly receive a blocking plug 225 and a lock plug 224. As shown in FIG. 12, the lock plug 224 receives the locking bar 124 of the third lock structure when the door is to be in the partially open position of FIGS. 1A, 1B. Similarly, when the door is fully closed, the locking bar 124 will be as shown in the dotted lines at the center of FIG. 12 and will enter the right side of the center locking plug 324.

When it is desired to change from one hand to the other, the head stop 210 is removed by removing the attaching screws SS at each end thereof and then the plugs 224, 225 and 324 are reversed to appear as shown in FIG. 13. That is, the two end plugs 224 and 225 are interchanged, with the locking bar reception plug 224 now being to the left, as indicated in FIG. 13 as 224R, and the blocking plug 225 is on the right end of the head stop 210R as indicated in FIG. 13. The center plug 324 has been reversed and is now referred to as 324R. As indicated again in dotted lines, the locking bar 124 will project into the open side of the center plug 324R in this configuration. The view of FIG. 14 merely shows the head stop 210R as mounted in FIG. 13, and will appear similar to this for the FIG. 12 arrangement. It should be noted that a weather seal structure WS is provided along the door associated edge of the head stop.

Figure 15:
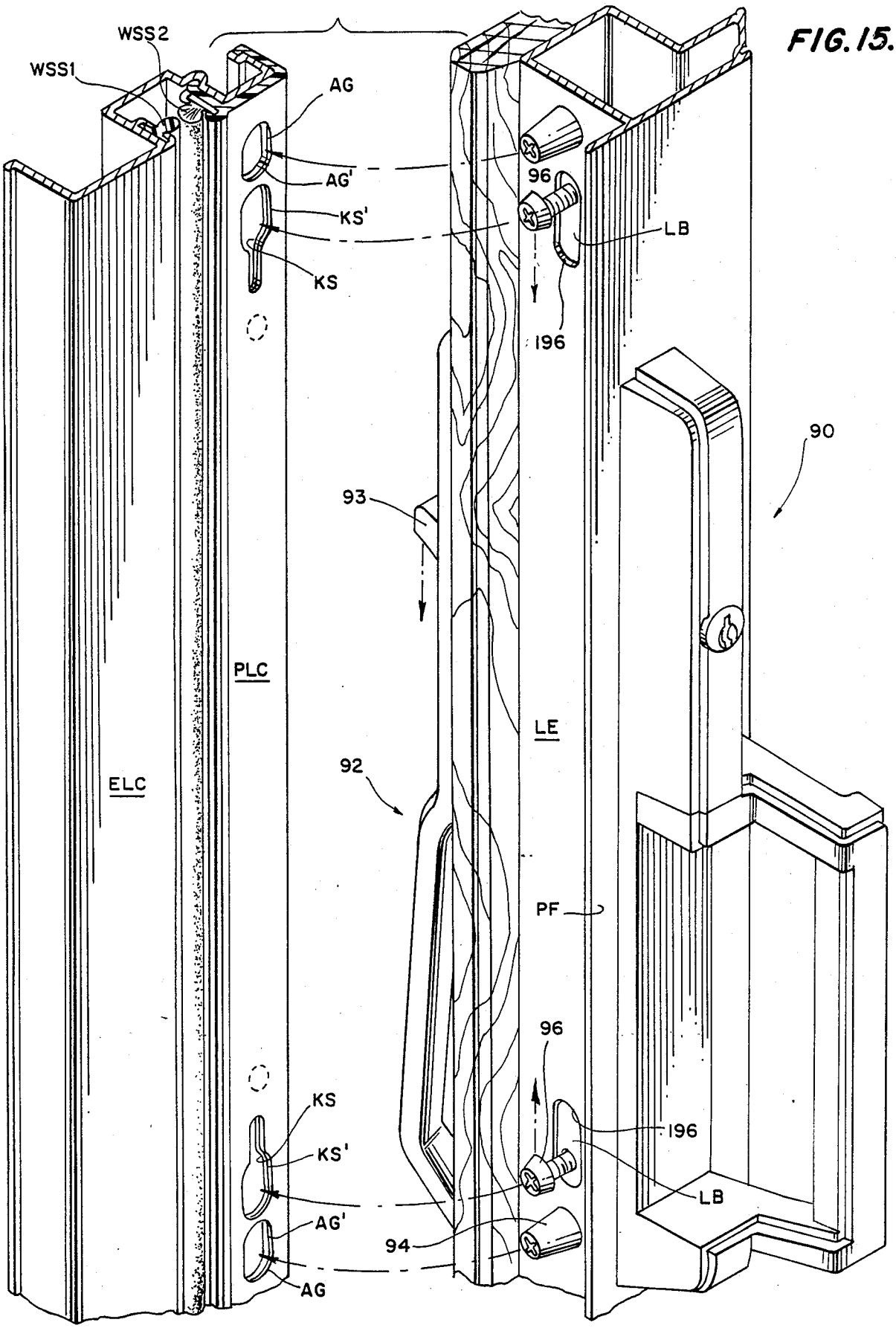
FIG. 15 is an exploded perspective view of the primary dual lock system for the sliding glass door.
Figure 16:
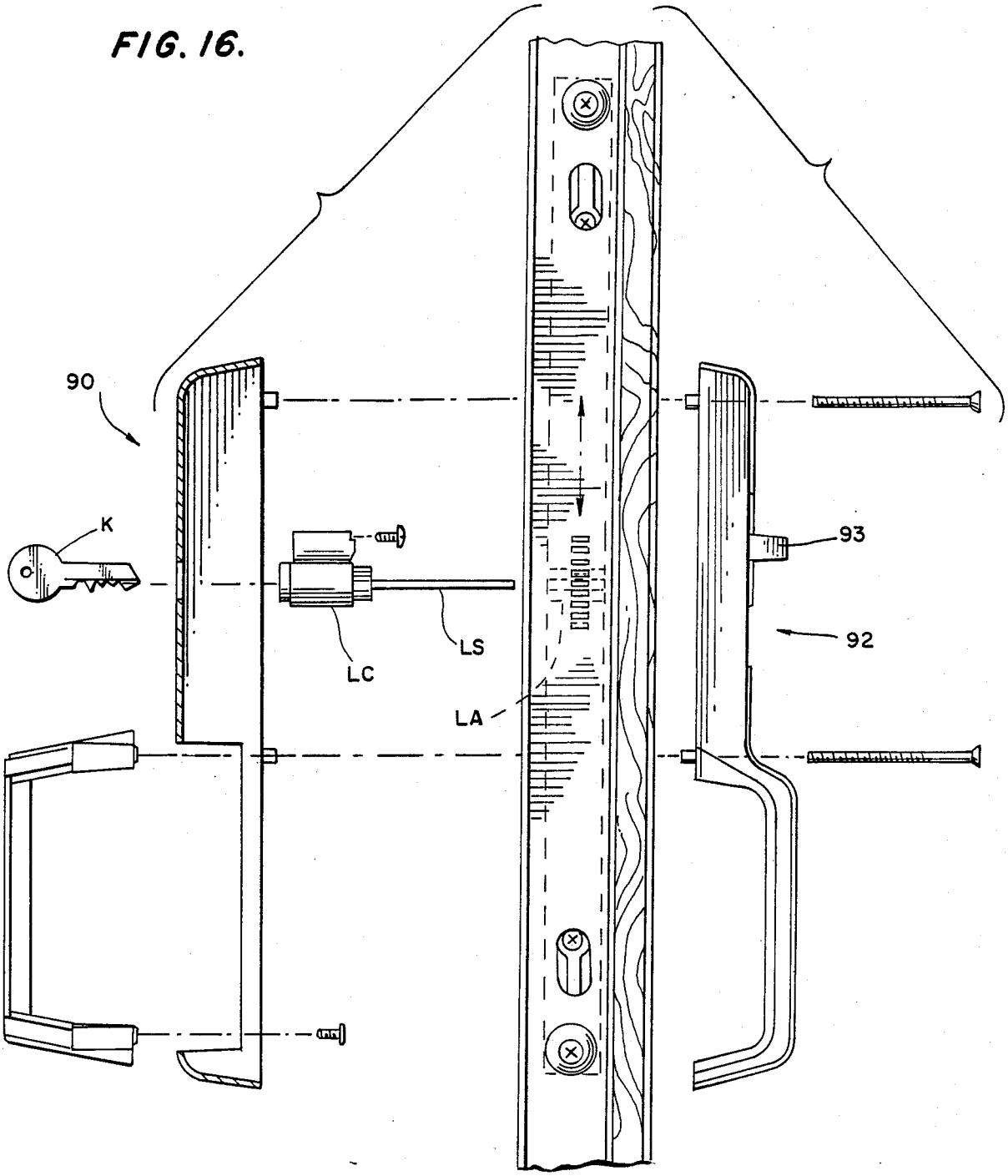
FIG. 16 is a side elevational view, partly exploded, of the right-hand portion of the dual lock mechanism depicted in FIG. 15.

Looking at FIGS. 15 and 16 of the drawings, the primary dual lock pin door lock will now be described in detail. The outside portion of this lock is indicated by reference numeral 90 and the inside portion by 92. The lock tumbler with key and lock assembly are affixed together by the lock bolts shown in FIG. 16 in conventional fashion. For example, an actuating structure similar to that shown in any of U.S. Pat. Nos. 2,166,535, 3,086,383 and 3,308,579 could be used. In these patents, rotation of a shaft causes a pair of pins to extend simultaneously in opposite directions to effect locking and unlocking of the structure. The key K and latch 93 in FIGS. 15 and 16 would serve to actuate the lock pins 96 through lock shaft LC and lock actuator LA in essentially the same way as accomplished in these patents. No part of this basic construction is part of the present invention. However, the mechanism actuated by this structure is a very important part of the present invention. In the present invention, rotation of key K in lock cylinder LC causes rotation of lock shaft LS to rotate lock actuator LA, or actuation of door latch 93 rotates lock actuator LA, to cause movement of lock bars LB. The lock pins 96 are adjustably mounted within the actuating mechanism at the respective ends of the lock base LB and ride in slots 196 within the sliding glass panel vertical frame extrusion. It should be noted that as the door latch 93 is actuated, the locking pins 96 will move toward each other to engage with keyhole slots in an aluminum extrusion lock cover ELC which is appropriately attached through attaching apertures indicated in dotted circles (see the left side of FIG. 15). This extrusion ELC has appropriate keyhole KS slots at both ends thereof together with aligning and guiding apertures AG outboard of the key slots. The aligning and guiding apertures AG complement and guide the projections 94 appropriately affixed and screwed to the lock extrusion LE. In addition to the aligning and guiding apertures AG and the keyhole lock slots KS in the aluminum extrusion ELC, a plastic lock cover plate PLC is appropriately snapped over the aluminum member after affixation thereof to the appropriate wood backing structure. This plastic lock cover PLC has apertures AG, and KS, to align with those in the metal portion.

Another very important component part of the plastic lock cover is the weather seal structure $WSS_2$ which slides into an appropriate recessed channel on the edge of this plastic lock cover. This weather seal $WSS_2$ preferably is made of a backing strip having a felt outer surface thereon of conventional construction. To complement this weather seal, another weather seal structure $WSS_1$ of foam covered material is provided in the metal extrusion ELC. When the projecting flange PF of the sliding glass door passes between weather seal $WSS_1$ and weather seal $WSS_2$, a very airtight and weather resistant closure is effected.

Figure 17:
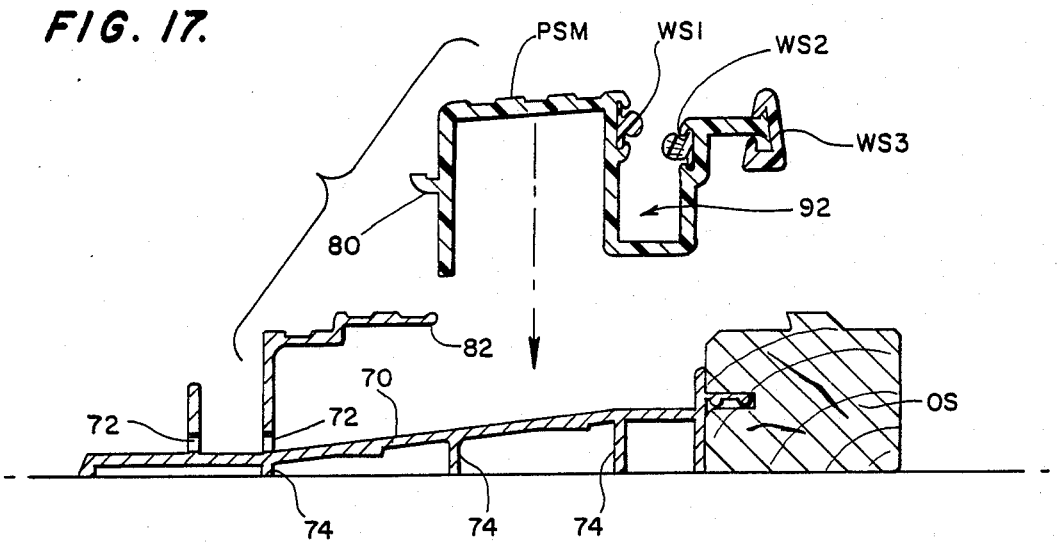
FIGS. 17–19 are cross-sectional views of the sill structure with replaceable plastic sill support member.
Figure 18:
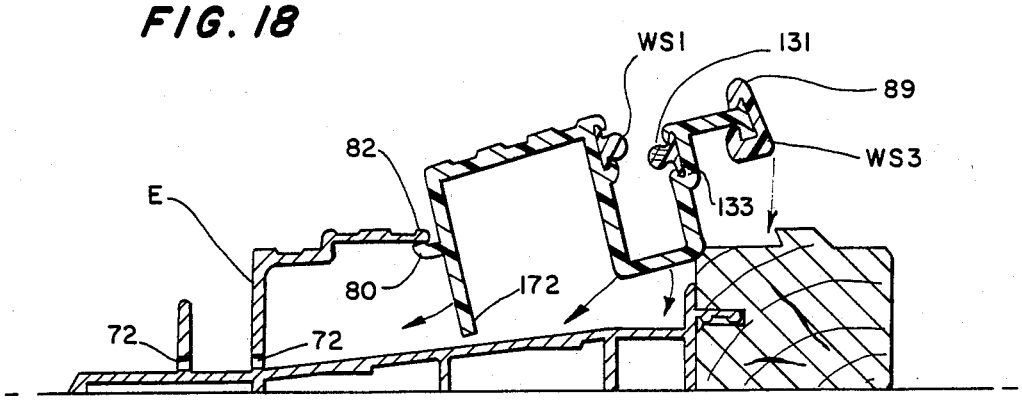
Figure 19:
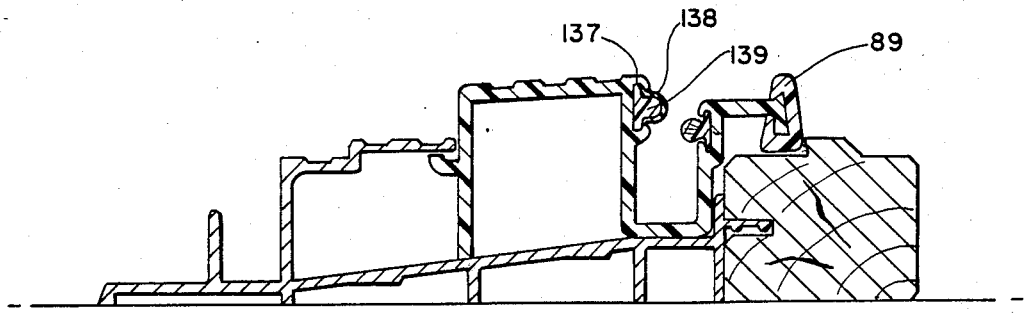

FIGS. 17–19 show the improved construction of the sill for the frame and door assembly of the present invention. This sill 70, as also shown at the bottom of FIG. 2, is of extruded aluminum with weep slots 72 provided along the upper ribs thereof at spaced points therealong. Vertical strengthening ribs 74 are also part of this extrusion to give strength and rigidity to the sill. A very important improvement of the sill arrangement is the removable and replaceable plastic sill member PSM. As shown in the respective views, this member is separate from the sill extrusion with attached and affixed oak sill OS which is mounted as the bottom part of the overall frame. The plastic sill member, depending upon which hand configuration is to be effected, will be mounted by putting the edge or projection 80 of the sill member under the projection 82 of the aluminum extrusion. As depicted in FIG. 18, the sill member PSM is partially installed with the aluminum wood sill. In FIG. 19 the somewhat flexible yet semi-rigid sill member PSM has been fully mounted with the aluminum/wood base portion. The channel 92 has weather seal recesses near the open portion thereof for reception of the weather seal strips $WS_1$, $WS_2$. Again, the weather seal strip $WS_1$ is preferably a piece of projecting soft foam material 139 mounted upon a semi-rigid yet flexible backing strip 137 and in turn covered with flexible plastic material 138. The weather seal $WS_2$ to complement with the first weather seal is preferably felt strip 131 mounted upon a suitable mounting strip and backing 133 slid into a similar recess within the plastic insert member PSM. An additional plastic weather seal structure $WS_3$ is provided along the outer edge of the sill member for additional sealing function.

Preferably, the plastic material used for both the sill member PSM and the lock cover member PLC is of space age type plastic material having very long life, being flexible yet semi-rigid, and having a certain degree of low friction surface characteristics. In actual use, a material having the trade name of LEXAN has been found to be quite suitable. However, any similar material may be employed in the actual door construction.

It should be noted that in FIG. 2 the sliding glass panel 15 is mounted upon a dual pair of track rollers TR for appropriate riding on the guide member 89 of the sill structure.

It should also be noted that the self-draining weep holes 172, as indicated in dotted lines in FIG. 18 at the lower edge of the plastic sill member PSM, are staggered in relation to the permanent weep holes 72 provided in the aluminum extrusion E. The purpose, of course, is to prevent wind blow through at the lower portion of the overall door assembly.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sliding door assembly comprising:

a frame having two vertical jambs, a head jamb, and a sill;

at least one fixed glass door panel mounted in said frame;

at least one slidable glass door panel mounted movably in said frame, said door panel having a closure edge;

means for weather sealing the sliding glass door panel around a substantial portion of the perimeter thereof; and locking means for said sliding glass door panel for locking same at three points, in a completely closed position as well as one point in a partially open position, said locking means including a primary dual lock having spaced apart, opposed locking pins protruding through the closure edge of the door panel and movable toward and away from one another in associated locking pin receiving openings in the associated vertical jamb of the door frame to lock and unlock the door, and at least one guide pin protruding from the closure edge of the door panel adjacent at least one of the locking pins and in alignment with a guide opening in the associated vertical jamb of the door frame to align and guide the locking pin into proper operative relationship with the locking pin receiving openings.

2. The sliding door assembly of claim 1, wherein said sill includes self-draining means therewith for effecting water flow away therefrom.

3. The sliding door assembly of claim 1, wherein said sill includes a replaceable sill cover member of wear resistant synthetic plastic material.

4. The sliding door assembly of claim 1, wherein said frame is made of aluminum and has an aluminum exterior together with replaceable wood inserts on the interior thereof.

5. The sliding door assembly of claim 4, wherein said replaceable wood inserts are provided with clip-on means for making the installation and removal of same quick and easy.

6. The sliding door assembly of claim 1, wherein said assembly is of alternate-hand construction permitting the fixed glass panel, as well as the sliding glass panel and associated components, to be made into either a right-hand or a left-hand structure during installation on the actual job site.

7. The sliding door assembly of claim 1, wherein said means for weather sealing the sliding glass panel around a substantial portion of the perimeter thereof includes a protruding fin on the perimeter of the sliding glass panel, and at least one flexible weather seal means on the associated frame elements to cooperate with said fin.

8. The sliding door assembly of claim 7, wherein two oppositely opposed seal means are provided adjacent the sliding glass door perimeter for cooperation with the extending fin thereof, one seal means being on the outside portion of said door and the other seal means being on the inside portion thereof.

9. The sliding door assembly of claim 2, wherein said self-draining means includes a plurality of weep slots provided in said sill, with adjacent slots being staggered relative to each other so the slots are not directly opposite each other for the purpose of reducing any wind blow-through through said sill.

10. The sliding door assembly of claim 3, wherein said replaceable plastic member includes weather seal means on one surface thereof for engagement with complementary fin structure on the bottom of said sliding glass door.

11. The sliding door assembly as claimed in claim 1, further comprising:

vertical center post means extending between said head jamb and sill of the frame for substantially increasing the structural strength of said frame.

12. A patio door construction comprising a frame designed to receive at least two glass panels therein, at least one fixed glass panel mounted in said frame, at least one slidable glass panel mounted for movement longitudinally in said frame and having a closure edge, locking means for said sliding glass panel for securing same at three points in a completely closed position as well as at one point in a partially open position, and weather sealing means with said sliding glass panel for complementary association with weather seal structure affixed to the frame assembly, said locking means comprising a reversible door mounted unit including a longitudinally movable latch bar and a complementary head stop mounted upon the frame, said latch bar being reversible on the door and movable into a recess in the head stop, and said head stop including removable and reversible locking plugs to change the configuration of the head stop upon reversal of the locking means.

13. The patio door construction of claim 12, wherein said entire structure can be moved from the side edge of a movable panel and the movable panel rotated 180° and the lock mechanism re-installed so as to reverse the hand of the assembly.

14. The patio door construction of claim 12, wherein said sill structure includes a replaceable synthetic plastic sill cover member for supporting the slidable panel thereupon, and cooperating therewith to complete the weather sealing arrangement at the lower portion of said slidable panel.

15. A patio door construction, comprising:

a frame designed to receive at least two glass panels therein;

at least one fixed glass panel mounted in said frame;

at least one slidable glass panel mounted for movement longitudinally in said frame and having a closure edge;

locking means for said sliding glass panel for securing same at three points in a completely closed position as well as at one point in a partially open position, said locking means including a primary dual pin locking structure on the closure edge of the movable panel, said dual pin locking structure complementing with a frame reception member having dual keyhole slots therein arranged to receive said dual locking pins to securely lock the slidable panel at two points, said locking means further including at least one guide pin protruding from the closure edge of the movable panel in alignment with a guide opening in the frame for entry of the guide pin into the guide opening to insure proper engagement of the dual pin locking structure in the dual keyhole slots; and weather sealing means on said sliding glass panel for complementary association with weather seal structure affixed to the frame assembly, said weather sealing means comprising a projecting flange around at least three sides of the sliding glass panel on the perimeter thereof, and said complementary sealing structure associated with the frame assembly comprising oppositely opposed flexible and resilient seal means arranged in the frame structure so that the respective seal structure will engage opposite sides of the projecting flange of said sliding glass panel.

16. In a sliding glass patio door having a frame with spaced vertical jambs, and at least one sliding glass patio door panel having a closure edge for opening and closing movement with respect to one of the vertical jambs, the improvement comprising:

a dual pin lock assembly for attachment to the closure edge of the door panel and having a pair of spaced apart, opposed lock pins projecting through the closure edge and connected to be moved together toward and away from one another for locking and unlocking engagement in a pair of spaced apart locking openings in the vertical jamb of the door frame; and at least one aligning and guiding projection adjacent the lock pins for engagement in a guide opening in the jamb of the door frame to align the door to the frame for proper operation of the lock.

17. The patio door construction of claim 16, wherein aligning pins are on the closure edge of the movable panel, adjacent the locking pins for complemental engagement in apertures in the frame for assuring that the locking pins properly mate with the keyhole slots for a properly aligned panel with frame assembly arrangement.

18. The patio door construction of claim 17, wherein said locking means for said sliding glass panel includes a reversible door mounted unit for actuating a longitudinally movable latch bar which can extend into and mate with a complementary head stop mounted upon the frame.

19. The patio door construction of claim 18, together with an overhead stop having interchangeable plugs therewith for changing the locking arrangement of the slidable panel when reversing the hand thereof.

20. The patio door construction of claim 19, together with a sill structure having a replaceable plastic member for supporting the slidable panel thereupon, and cooperating therewith to complete the weather sealing arrangement at the lower portion of said slidable panel.

21. A patio door construction comprising a frame designed to receive at least two glass panels therein, at least one fixed glass panel mounted in said frame, at least one slidable glass panel mounted for movement longitudinally in said frame, locking means for said sliding glass panel for securing same at three points in a completely closed position as well as at one point in a partially open position, said locking means including a dual pin locking structure complementing with a frame reception member having dual keyhole slots therein arranged to receive said dual locking pins to securely lock the slidable panel at two points, and including aligning pins and apertures for assuring that the locking pins properly mate with the keyhole slots for a properly aligned sliding panel with frame assembly arrangement, and wherein said locking means for said sliding glass panel includes a reversible door mounted unit for actuating a longitudinally movable latch bar which can extend into and mate with a complementary head stop mounted upon said frame, and weather sealing means with said sliding glass panel for complementary association with weather seal structure affixed to the frame assembly.

22. The patio door construction of claim 21, together with an overhead stop having interchangeable plugs therewith for changing the locking arrangement of the slidable panel when reversing the hand thereof.

23. A reversible lock assembly for a sliding glass patio door slidably movable in a door frame and having a top edge, a bottom edge and leading and trailing edges, comprising:

an overhead stop for attachment to the door frame, said stop having a plurality of lock receiving openings therein and reversible plugs for receipt in the openings to change the configuration of the stop for left-hand or right-hand operation of the door;

a lock frame for attachment to the trailing edge of the door;

a pivoted lock actuating lever mounted in the lock frame for movement between locked and unlocked positions;

a longitudinally movable connecting bar connected at one end to be moved by the actuating lever when the lever is pivoted; and a reversible locking bar connected to the other end of the connecting bar for longitudinal movement with the connecting bar to move the locking bar into and out of locking engagement in a respective one of said openings in the stop, reversal of the locking bar enabling the lock to be configured for either right-hand or left-hand operation of the door.

* * * * *